US005383525A

United States Patent [19]

Daly et al.

[11] Patent Number: 5,383,525

[45] Date of Patent: Jan. 24, 1995

[54] THREADED RING RETENTION MECHANISM

[75] Inventors: Jeffery E. Daly, Cypress; Patsy N. Kepka, Pasadena, both of Tex.

[73] Assignee: Camco International Inc., Houston, Tex.

[21] Appl. No.: 110,854

[22] Filed: Aug. 24, 1993

[30] Foreign Application Priority Data

Aug. 26, 1992 [GB] United Kingdom ..... 9218100

[51] Int. Cl.[6] ..... E21B 10/08

[52] U.S. Cl. ..... 175/57; 175/371; 29/525.1; 29/456; 411/937.2

[58] Field of Search ..... 29/525.1, 456, 505; 411/937.2, 307–311, 271, 325; 175/57, 371

[56] References Cited

U.S. PATENT DOCUMENTS 5,011,352 4/1991 Hatter ..... 411/937.2 X 5,145,300 9/1992 Wallace ..... 411/937.2 X

*Primary Examiner*—William P. Neuder

[57] ABSTRACT

A method of manufacturing a rolling cutter drill bit of the kind where each cutter is rotatably mounted on a bearing spindle on the bit body and is retained on the spindle by a threaded retention ring in screw-threaded engagement with the cutter. The retention ring is provided with an aperture to expose a portion of the screw-thread on the cutter and an implement is passed along a registering passage in the spindle and through the aperture in the retaining ring to deform or otherwise alter the exposed screw-thread in a manner to prevent subsequent relative rotation between the screw-threads, thereby locking the retention ring to the cutter. Instead of deforming the screw-thread it may be formed with a recess which is engaged by a pinning element secured in the aperture in the retaining ring.

16 Claims, 4 Drawing Sheets

FIG 1
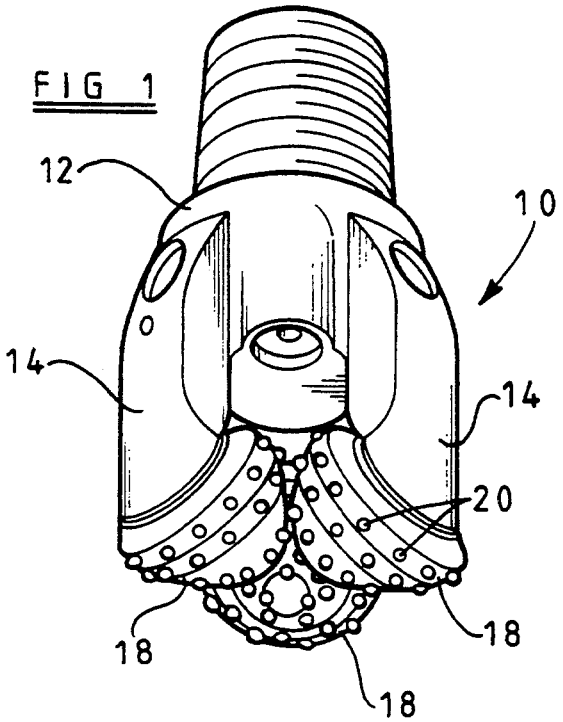
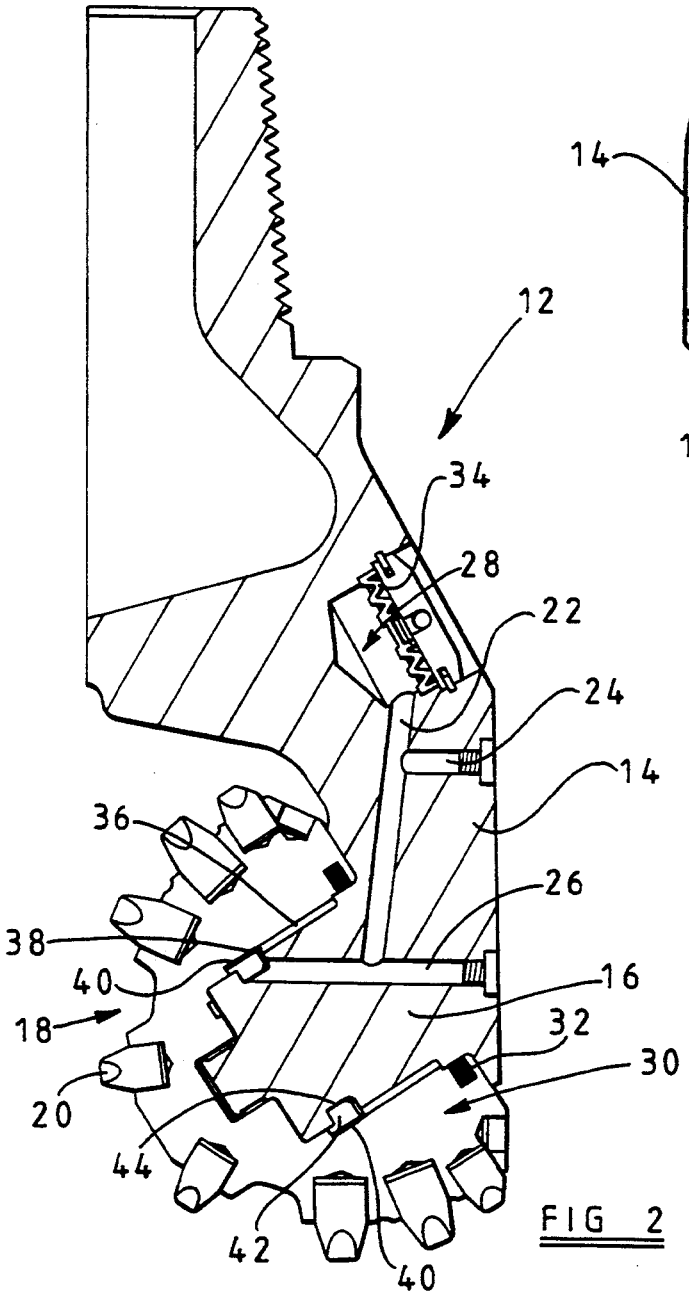
FIG 2

THREADED RING RETENTION MECHANISM

BACKGROUND OF THE INVENTION

Field of the Invention

This invention relates to an improved mechanism for assembling cutters on supporting bearing spindles in roller cutter earth boring bits. The invention reduces the number of catastrophic drill bit failures due to cutter loss during the drilling operation, thereby providing greater reliability and reduced wellbore drilling costs.

Much of the cost associated with drilling wellbores into the earth for recovery of hydrocarbons is directly related to the performance of the earth boring bit. Although the cost of the bit itself is often trivial in relation to other drilling expenses, the consequences of an unexpected or premature bit failure are significant. For example, a typical 7⅞" three rolling cutter drill bit costs about $4,500. If one or more rolling cutters of this drill bit were to come off during drilling, the additional cost to recover the "junk" cutter could exceed $150,000. If the wellbore is deeper than about 10,000 ft. or is deviated from vertical more than about 30 degrees (as in directional drilling), the cost to recover the lost cutter could easily be $300,000. Therefore, one critical component of all modern, sealed rolling cutter earth boring bits is its mechanism for retaining the cutter on the body of the bit.

Cutter retention systems are well known in the art. For example, ball bearings can be inserted through a hole in the body to fill a groove between the rolling cutter and the bit body as shown in U.S. Pat. No. 3,989,314. Alternatively, a snap ring can be positioned in the same general area as the ball bearings as shown in U.S. Pat. No. 4,236,764. Finally, a split threaded thrust bearing member can be installed in the bit as shown in U.S. Pat. No. 3,971,600. Other threaded ring rolling cutter retention mechanisms are shown in U.S. Pat. Nos. 4,911,255; 4,991,671; 5,012,701 and 5,024,539.

Through several years of wide commercial use, the threaded ring retention mechanism has been found to provide superior cutter retention performance as compared to the other retention systems as long as the threaded ring remains securely seated within the rolling cutter. If the threaded ring becomes unseated, i.e. unscrewed from its intended position, the resulting excessive axial cutter displacement is detrimental to the cutter seal, resulting in premature bearing failure and shorter than expected bit life. As described in U.S. Pat. No. 3,971,600, the threaded ring is designed to resist unseating (unscrewing) after the bit is assembled by provision of a right hand thread so that the threaded ring will not loosen as the cutter turns in drilling using the normal clockwise drill bit rotation. In spite of this design, extensive analysis of used bits has indicated that the most common failure mode of the threaded ring was unseating.

Forces present during drilling can cause loosening of the threaded ring, especially when drilling wellbores with angular deviations greater than about 30 degrees from vertical. There are times during the drilling operation when the rolling cutter of a drill bit experiences reverse rotation. Because the threaded ring is designed to tighten during normal cutter rotation, reverse rotation of the cutter can cause the threaded ring to loosen. During normal wellbore drilling operations the rotation of the bit is often stopped so that an additional section of drill pipe can be added to the drill string. During this operation, the drill string and drill bit are first raised then lowered in the wellbore without rotation. If one cutter of the bit is scraping the side of the wellbore as the drill string is raised or lowered, the dragging action can cause reverse rotation of the cutter. The force of gravity urging the bit against the side of a directional wellbore makes this sidewall scraping worse, and consequently increases the chances of reverse cutter rotation, as the wellbore increasingly deviates from vertical.

The trend in today's oil and gas industry is to drill more highly deviated and horizontal wellbores. Due to the higher hourly rates for the specialised equipment required for this drilling, bit performance and reliability are critical. This is also the same type of drilling where reverse cutter rotation is most likely to occur. It is critical to keep the threaded retention ring securely locked in place during any conditions which may be encountered during drilling. It is also critical to provide very high resistance to further turning of the ring if it were to become loose. Therefore, the reliability of the locking means for the threaded retention ring is critical. For these reasons, there is a need for a drill bit with a threaded ring cutter retention system which is capable of withstanding reverse cutter rotation or any other condition encountered during drilling without loosening of the threaded ring.

SUMMARY OF THE INVENTION

The present invention has been contemplated to overcome the foregoing deficiencies and meet the above described needs.

According to one aspect of the invention there is provided a method of manufacturing a rolling cutter drill bit of the kind comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, the method comprising the steps of providing in one of said retention ring and the component which it screw-threadedly engages an aperture which passes through a portion of one of the screw-threads to expose a portion of the other screw-thread, forming the drill bit with a passage which extends from the exterior of the bit to said aperture in said one screw-thread so as to provide access to said exposed portion of the other screw-thread, and physically altering said exposed portion of the other screw-thread in a manner to prevent subsequent relative rotation between the screw-threads, thereby locking the retention ring to the component which it screw-threadedly engages.

This interlocking has been found, through testing, to provide a high degree of resistance to loosening for the threaded ring. The threaded rings of bits made in accordance with the present invention have been found to withstand reverse cutter rotation without becoming loose, even when drilling highly deviated wellbores.

The portion of the other screw-thread may be physically altered by being mechanically deformed by an implement inserted along said passage and through said aperture. Preferably said mechanically deformed other screw-thread is provided with greater yield strength than said one screw-thread containing said aperture.

Said exposed portion of the other screw-thread may be plastically deformed by impact thereon of said implement.

The retention ring may be in screw-threaded engagement with the cutter, the retention ring having an external screw-thread which engages an internal screw-thread on an interior surface of a cavity formed in the cutter.

In one such embodiment of the invention the aperture is formed in the retaining ring and exposes a portion of the internal screw-thread on the cutter, said passage being formed in the bearing spindle and extending from the exterior of the bit to said aperture in the retaining ring to provide access, through said passage and aperture, to said exposed portion of the screw-thread on the cutter.

The invention also provides a rolling cutter drill bit comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, there being provided in one of said retention ring and the component which it screw-threadedly engages an aperture which passes through a portion of one of the screw-threads to expose a portion of the other screw-thread, said exposed portion of the other screw-thread being physically altered in a manner to prevent relative rotation between the screw-threads, thereby locking the retention ring to the component which it screw-threadedly engages.

According to a second aspect of the invention there is provided a method of manufacturing a rolling cutter drill bit of the kind comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, the method comprising the steps of providing in one of said retention ring and the component which it screw-threadedly engages an aperture which passes through a portion of one of the screw-threads to expose a portion of the other screw-thread, forming the drill bit with a passage which extends from the exterior of the bit to said aperture in said one screw-thread so as to provide access to said exposed portion of the other screw-thread, providing a recess in said exposed portion of the other screw-thread, and securing in said aperture a pinning element having a portion which engages within said recess in a manner to prevent subsequent relative rotation between the screw-threads, thereby locking the retention ring to the component which it screw-threadedly engages.

Said recess may be formed in the exposed portion of said other screw-thread by physically deforming said exposed portion of the screw thread after assembly of the cutter, retention ring and spindle.

Said recess may be formed by mechanical deformation of the exposed portion of said other screw-thread by an implement inserted along said passage and through said aperture. For example, said recess may be formed by impact on the exposed portion of said other screw-thread by said implement.

Said recess may be pre-formed in the exposed portion of said other screw-thread prior to assembly of the cutter, retaining ring and spindle, and brought into register with the aperture in said one screw-thread, to receive said portion of the pinning element, during said assembly.

The retention ring may be in screw-threaded engagement with the cutter, the retention ring having an external screw-thread which engages an internal screw-thread on an interior surface of a cavity formed in the cutter. In this case said aperture may be formed in the retaining ring to expose a portion of the internal screw-thread on the cutter, said passage being formed in the bearing spindle and extending from the exterior of the bit to said aperture in the retaining ring to provide access, through said passage and aperture, to said exposed portion of the screw-thread on the cutter.

The invention further provides a rolling cutter drill bit comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, there being provided in one of said retention ring and the component which it screw-threadedly engages an aperture which passes through a portion of one of the screw-threads to expose a portion of the other screw-thread, a recess in said exposed portion of the other screw-thread, and secured in said aperture a pinning element having a portion which engages within said recess in a manner to prevent relative rotation between the screw-threads, thereby locking the retention ring to the component which it screw-threadedly engages.

In a further aspect the invention provides a method of manufacturing a rolling cutter drill bit of the kind comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, the method comprising the steps of providing in one of said retention ring and the component which it screw-threadedly engages an aperture which passes through a portion of one of the components to expose a surface portion of the other component, forming the drill bit with a passage which extends from the exterior of the bit to said aperture so as to provide access to said exposed surface portion, providing a recess in said exposed surface portion, and securing in said aperture a pinning element having a portion which engages within said recess in a manner to prevent subsequent relative rotation between the retention ring and the component which it screw-threadedly engages.

BRIEF DESCRIPTION OF THE DRAWINGS

FIG. 1 is a perspective view of a rolling cutter drill bit of the present invention.

FIG. 2 is a cross sectional view of one preferred embodiment of an earth boring bit of the present invention showing the general arrangement of the cutter's lubrication and bearing system.

DESCRIPTION OF THE PREFERRED EMBODIMENTS

Figure 3A:
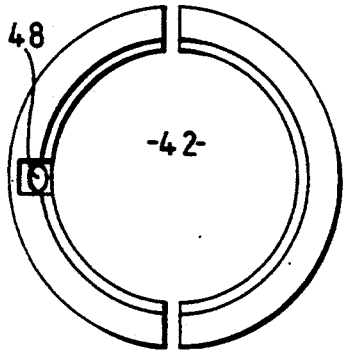
FIG. 3A is a plan view of one preferred embodiment of a threaded ring for use in a drill bit.
Figure 3B:
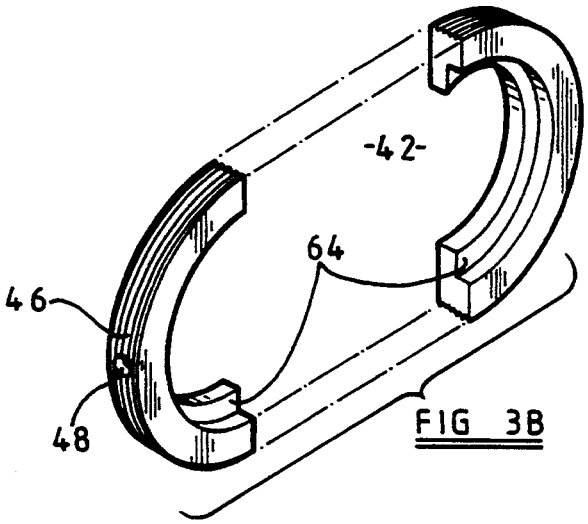
FIG. 3B is a perspective view of the threaded ring of FIG. 3A.
Figure 3C:
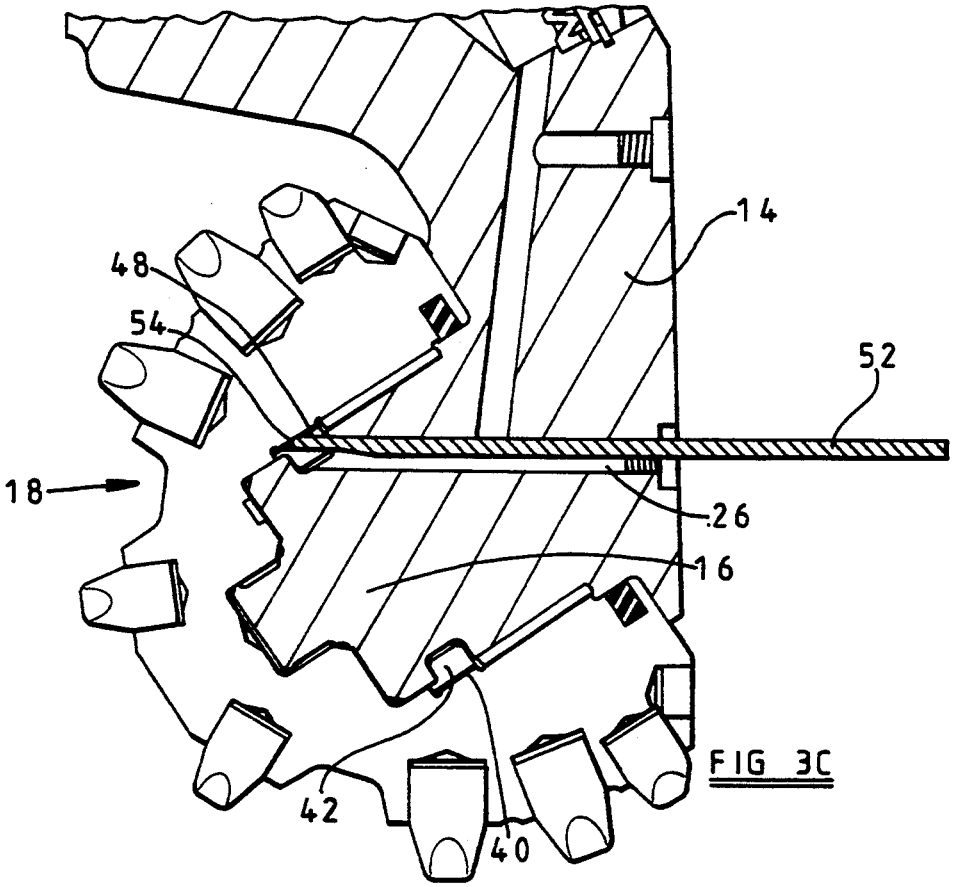
FIG. 3C is a cross sectional view of an earth boring bit of the present invention showing one preferred manner of thread deformation accomplished in accordance with the present invention.

Referring now to the drawings in more detail, and particularly to FIGS. 1 and 2, an earth boring bit 10 is a rolling cutter type of drill bit and includes a body 12 (portions of which are not shown). The body of a typical rolling cutter drill bit comprises three similar leg portions 14 (only two are shown). A cantilevered bearing spindle 16 formed on each leg 14 extends inwardly and downwardly. A rolling cutter 18 is rotatably mounted upon the spindle 16 as hereinafter explained. Attached to the rolling cutter 18 are cutting inserts 20 which engage the earth to effect a drilling action and cause rotation of the rolling cutter 18. Typically, each cutting insert 20 will be formed of hard, wear resistant material. Internal passageways 22, 24 & 26, as well as a reservoir 28 and bearing area 30 of the leg 14, are filled with lubricant (not shown) during bit assembly. The lubricant helps reduce friction during bit operation and is retained within the cutter 18 by a dynamic seal 32. One passageway 26 provides an access used in assembly of the bit. Pressure differentials between the lubricant and the external environment of the bit are equalised by the movement of a pressure balance diaphragm 34.

The cutter 18 is mounted upon the cantilevered bearing spindle 16 formed on the leg 14. A separate sliding bearing member 36 is mounted between the spindle 16 and a mating bearing cavity 38 formed in the cutter 18. An internal thread 40 is formed on the surface of an internal cavity of the cutter adjacent the bearing area 30, and a split externally threaded retaining ring 42 is positioned in a peripheral groove 44 on the spindle 16 and is threadedly engaged with the threads 40 on the cutter. This threaded ring 42 retains the cutter upon the spindle, as explained in U.S. Pat. No. 3,971,600.

The dimensional characteristics of the threaded ring 42, the groove 44 in the spindle 16, and the cavity 38 in the cutter are such as to allow some axial displacement of the cutter 18 with respect to the spindle 16. Manufacturing tolerances usually establish this permitted axial displacement to a maximum of about 0.017". If the threaded ring 42 were to become loosened on the cutter 18, the axial displacement would dramatically increase. For example, in a typical drill bit, a rotation of 120 degrees (⅓ of a full turn) of the threaded ring 42 from its intended position would double the axial displacement of the cutter on the spindle during operation. As noted in U.S. Pat. No. 3,971,600, excessive axial displacement leads to premature seal failure. Also, modern drill bits are designed with very close spacing between the cutting inserts 20 projecting from one cutter and the surface of the adjacent cutter. If the threaded ring 42 were to loosen just one full turn, the cutting inserts of one cutter 18 would engage the adjacent cutter, causing catastrophic fracture of the cutting inserts.

Reference will now be made to FIGS. 3A, 3B, 3C, 4A and 4B. For earth boring bits, the inventors hereof have found that to securely lock the threaded retention ring 42 in place, some form of mechanical interference or interlocking must be created between the retention ring and the rolling cutter. In accordance with the present invention, after the assembly of the cutter 18 upon the bearing spindle 16, a mechanical interlocking means is applied to prevent subsequent loosening of the threaded ring. The interlock can be created by physically altering the threads 46 on the threaded retention ring 42, the internal threads 40 in the rolling cutter 18, or both thread sets. Alternatively, the interlock can be created by providing a separate pin 58 (see FIG. 4B) secured in a hole 48 in the threaded ring 42 and engaging a recess 50 in the cutter. Field testing has shown that when the retention ring 42 and cutter 18 are mechanically interlocked in accordance with the above described invention the threaded ring 42 does not loosen during operation. In fact these bits have been extremely difficult to disassemble due to the effectiveness of this interlock. Test comparisons illustrating this effectiveness are provided herein.

For applications where the cutter threads 40 are altered, the difference in yield strength between the threaded ring 42 and the rolling cutter 18 can be used to advantage. In the preferred embodiment, shown in FIGS. 3A, 3B, 3C and 4A, the hole 48 is preformed in the threaded ring 42 so as to provide access, after assembly, to an exposed portion of the threads 40 on the cutter 18. The thread alteration is performed by a thin cylindrical tool 52 formed from material of higher yield strength than the cutter threads. A rounded end portion 54 of this tool 52 has a diameter slightly less that the diameter of the hole 48 in the threaded ring 42. The remainder of the tool 52 can have a larger diameter to help resist bending during use. During assembly, after the threaded ring 42 and cutter 18 have been assembled and seated upon the bearing spindle 16, as is well known to those skilled in the art, the tool 52 is introduced through the passage 26 in the spindle 16 so that the rounded end 54 of the tool passes through the hole 48 in the ring 42 and bears against the threads 40 of the cutter. The other end of the tool 52 is then struck with enough force to plastically deform the cutter threads 40 without causing thread fracture. The outline of such a deformed area is shown at 56 in FIG. 4A. The yielded cutter material forms a crater like depression which overlaps the path of the threads 46 on the threaded ring 42. This overlap caused by thread yielding causes a mechanical interlock between the threaded ring 42 and the cutter 18. It was found through testing that two moderate blows with a ball peen hammer cause sufficient yielding for an effective interlock. This technique will hereafter be referred to as the "peening" process.

A mechanism which makes the peening process even more successful is the interaction between the relatively hard cutter threads 40 and the relatively softer threaded ring threads 46. As forces present during drilling attempt to loosen the threaded ring 42, the softer ring threads 46 are pushed over the deformed cutter threads 40. During this motion, a small segment of the threads 46 themselves becomes permanently deformed. This additional deformation further increases the effectiveness of the present invention. As will be described in more detail later, laboratory testing has shown breakout torque for peened assemblies ranges from 100 to 120 ft-lbs, increasing to more than 200 ft-lbs during the first revolution. Bits run in the field assembled with the peening technique are very difficult to disassemble, and those that are disassembled are severely damaged in the process.

Any means of effecting a significant change in the shape of the cutter's threads without significant loss of material will result in satisfactory mechanical interlocking. In the sense that there are many ways to cause this change, any deliberate action which causes physical distortion of the threads, even if the means used to distort the threads is non-mechanical, is considered applicable and part of the "peening" process.

The assembly method of the above described bit utilising thread distortion as a way to mechanically interlock the cutter 18 to the threaded retention ring 42 comprises the steps of assembling the threaded retention ring 42 about the bearing spindle 16 of the bit, mounting the rolling cutter 18 upon the threaded ring 42 and bearing spindle 16, and acting upon the threads 40 in the rolling cutter 18 such that they are mechanically altered to prevent rotation of the threaded ring 42 with respect to the cutter 18.

Figure 4A:
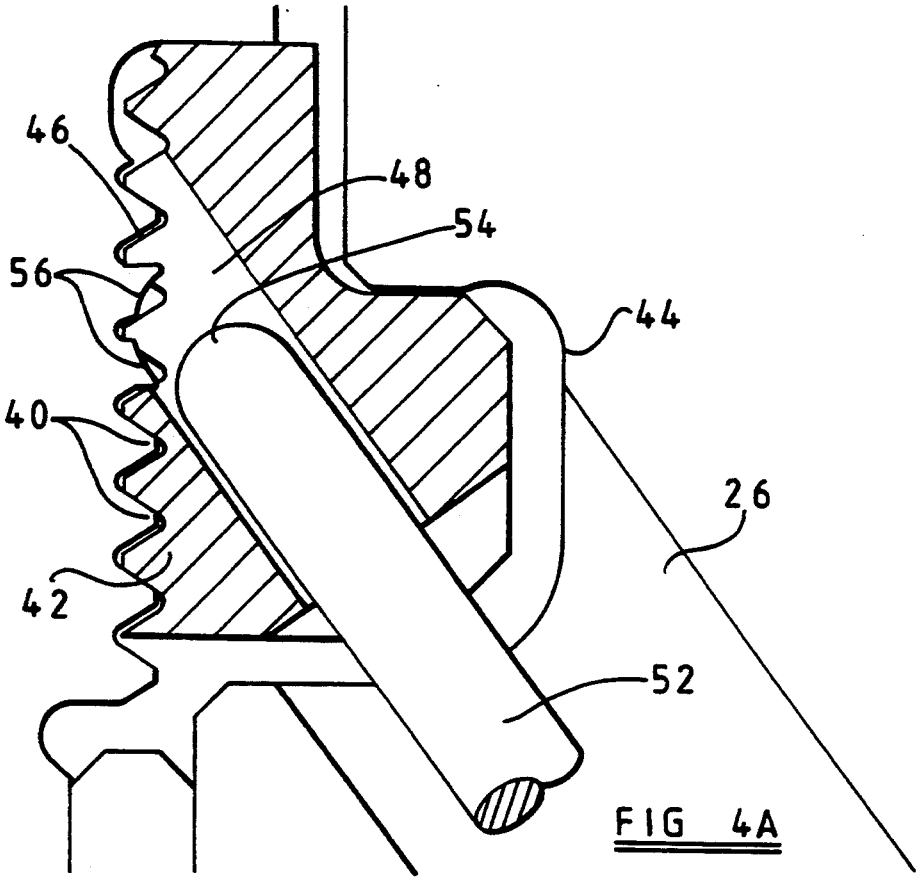
FIG. 4A is a cross sectional view of the threads of the threaded ring of the present invention.
Figure 4B:
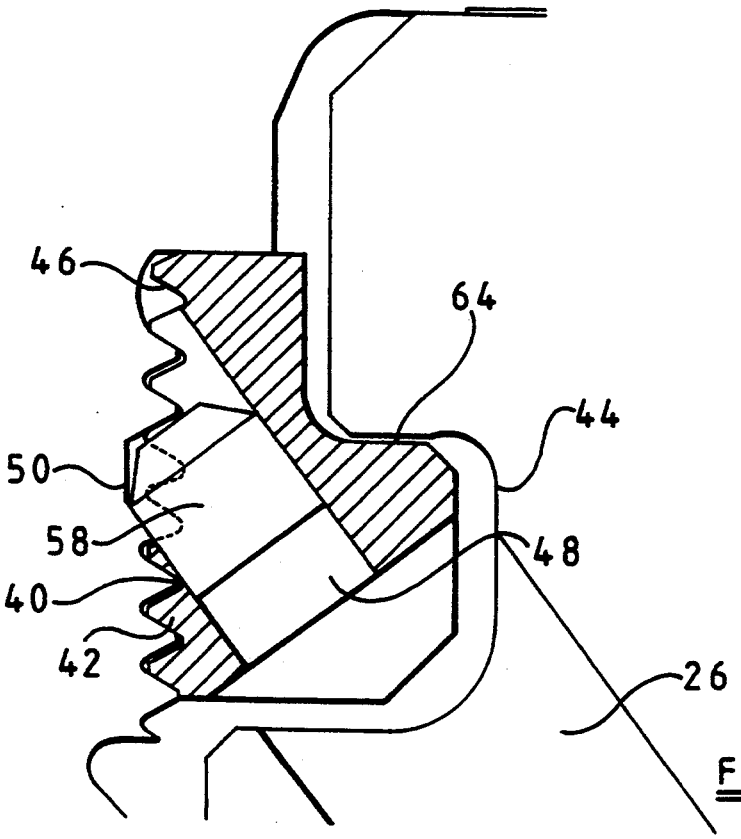
FIG. 4B a cross sectional view of the threads of an alternative preferred embodiment of the threaded ring of the present invention.

In an alternative preferred embodiment of the present invention shown in FIG. 4B a pin 58 is passed through the hole 48 in the threaded retention ring 42 and introduced into a recess 50 formed in the cutter. The pin 58 can be held in the hole 48 by an interference fit, screw-threading, gluing or any other suitable means. The recess 50 can be formed in the cutter threads 40 or elsewhere in the cutter 18.

Normal dimensional variations of the threaded ring 42 and the rolling cutter 18 occur during manufacture and these variations from piece to piece make the desired location of a particular pin 58 vary with respect to a particular cutter 18 once they have been assembled. For this reason, the recess 50 in the cutter is preferably formed after assembly with the threaded retention ring 42. One method of forming the recess 50 is striking a sharp cornered tool (not shown) inserted through the access hole 48 of the threaded retention ring 42. If this tool is sufficiently harder than the cutter threads 40, a portion of the threads in the cutter will be sheared off leaving a suitable recess 50. After the pieces of thread are removed, the pin 58 is inserted into the recess 50 and held in place as indicated above. Hereinafter, this method of preventing loosening of the threaded ring is called the "pinning" process.

Testing performed with pinned-type mechanical interlocking showed breakout torques of about 140 ft-lbs generally decreasing to about 40 ft-lb torque as the threaded ring was loosened. The primary failure mode of this design was shearing of the mild steel pin 58. The inventors believe that a harder and/or tougher pin material such as hardened AISI 4140 steel could increase this breakout torque to well beyond 200 ft-lbs.

The assembly method of the above described bit utilising a pinned means of interlocking the cutter 18 to the threaded retention ring 42 comprises the steps of assembling the threaded retention ring 42 about the bearing spindle 16 of the bit 10, mounting the rolling cutter 18 upon the threaded ring 42 and bearing spindle 16, and inserting a permanently attached pinning element 58 through the threaded retention ring 42 into the recess 50 formed in the rolling cutter 18 to prevent subsequent rotation of the threaded ring 42 with respect to the cutter 18.

Many modifications and variations may be made in the techniques and structures described and illustrated herein without departing from the scope of the present invention. For instance, the threaded ring could be threadedly attached to the bearing spindle 16, rather than to the cutter 18, in which case the threaded ring will be mechanically interlocked to the spindle by physically deforming the exposed threads on the retaining ring, or by engaging a recess in the threads on the retaining ring by a separate pinning member which is permanently secured within an aperture in the spindle. Also, methods other than peening which accomplish physical thread alteration—such as electrical discharge, thermal warpage, corrosion and melting, to name a few, may be equally effective. Finally, there are many alternative ways to form a suitable pinning recess in the cutter such as by drilling during assembly or by providing preformed grooves in the cutter prior to assembly.

To illustrate the improvement of the present invention, a series of tests were performed in the Research Laboratory of Reed Tool Co. to compare various means of preventing the threaded ring from turning within the cutter. Many conventional, prior art ways to secure the threaded ring within the cutter were tested for both breakout torque and resistive torque after one revolution. Bit assemblies designed in accordance with the present invention were also tested. A summary of the testing is presented in Table 1. The performance of these prior art designs compared to the performance of the design in accordance with the present invention emphasises the significance of the invention. All testing described herein was performed with the 2 5/16" diameter threaded ring described below and with standard production rolling cutters and bit bodies that were modified to acquire torque data. Empirical analysis of bits with threaded rings assembled with thread locking compound, run in the field, and later disassembled indicated that when breakout torques of about 50 ft-lbs or higher were required for disassembly, there was no evidence of the threaded ring having previously become loose. The used bits tended to require either significant breakout torques or near zero breakout torques to effect disassembly. The inventors concluded, therefore, that a breakout torque of about 50 ft-lbs or higher must be maintained during the bit's operation to securely lock the threaded ring within the cutter.

Figure 5A:
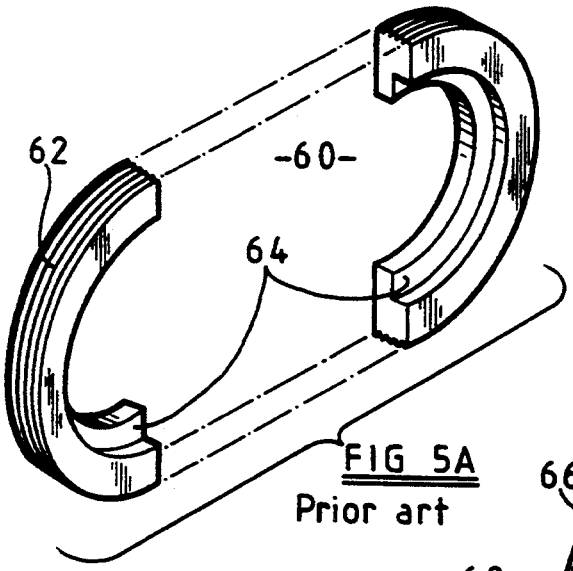
FIG 5A Prior art
FIG. 5A is a perspective view of a prior art split threaded ring.

FIG. 5A shows a typical prior art split threaded retention ring 60. A typical threaded ring 60 for a Reed Tool Co. 8½" HP51 drill bit has a 2 5/16" diameter, and a 16 threads per inch class UN-2A thread 62 formed on its outside diameter. For proper operation the fatigue resistance, yield strength and toughness of the ring must be optimised. Therefore, the threaded ring 60 is made of steel, preferably AISI 4140, hardened within 28 to 34 Rockwell "C" (Rc), with a preferred hardness of about 30 Rc. The thrust surface 64 of the threaded ring 60 may be plated with silver or other suitable material to help reduce rubbing friction. A mating thread, corresponding to the thread 40 in FIGS. 4A and 4B, is formed in a portion of the cutter which is typically hardened to about 40 Rc. Prior to the present invention, the liquid thread locking compound known as "PERMATEX" (Registered Trade Mark) "Secures Gears" (Registered Trade Mark) was the preferred locking means for the threaded ring 60. This compound was identified from an array of thread locking compounds as having the best compromise between thread locking ability and chemical compatibility with other rock bit components.

In the tests, the "Secures Gears" (Registered Trade Mark) thread locking compound used in the prior art provided a maximum breakout torque of about 180 ft-lbs which rapidly dropped to 30 ft-lbs during the first revolution, as shown in Table 1. It was found that jarring of the cutter before torque was applied could reduce the breakout torque to about 40 ft-lbs. These results are misleading, however, because many bits assembled with this thread locking compound and run in the field had less than 5 ft-lbs of breakout torque after being run. Many of these bits also showed clear evidence of the threaded ring having become loose during operation. The reason for the reduced holding power of the thread locking compound is loss of bond integrity. It is believed that the combination of thermal, chemical and mechanical agitation during drilling causes degradation of the thread locking material, allowing the thread to loosen.

Other prior art locking means were also tested with the results shown in Table 1. Test No. 2, for example, showed that tightening the threaded ring to about 200 ft-lbs torque resulted in a breakout torque of less than 5 ft-lbs. Once breakout occurred, the resistive torque was less than 1 ft-lb. It is believed that the high elastic modulus and yield strength of the cutter and threaded ring assembly prevents adequate elastic deformation for thread locking at the assembly torques possible for drill bits. Because of the difficulties in fixturing, an assembly torque of greater than 200 ft-lbs is impractical.

Figure 5B:
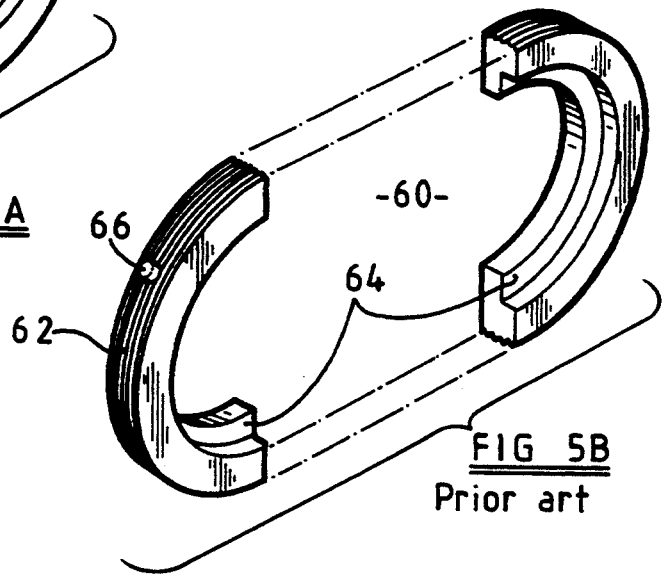
FIG 5B Prior art
FIG. 5B is a perspective view of a prior art threaded ring utilising a plastic insert thread locking system.
Figure 5C:
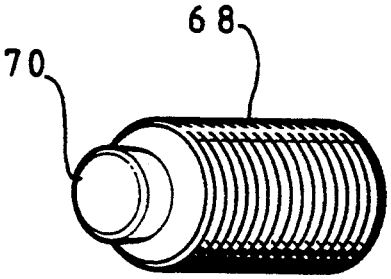
FIG 5C Prior art
FIG. 5C is a perspective view of a prior art setscrew type thread locking device.
Figure 5D:
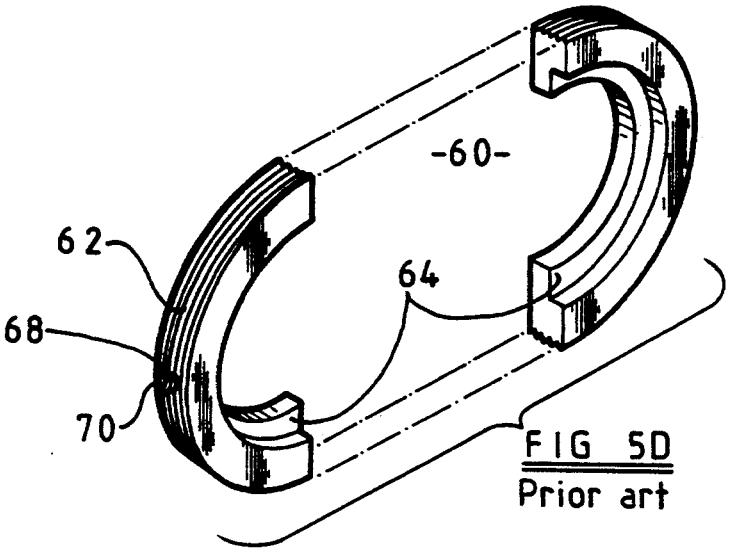
FIG 5D Prior art
FIG. 5D is a perspective view of a prior art threaded ring utilising the setscrew type retention system shown in FIG. 5C.

Another prior art thread locking device is the use of a tough plastics or plastics-like material as shown in FIGS. 5B and 5C. This material is inserted in a recess formed in the threads 62 of the threaded ring as shown by 66. Upon assembly, the device provides a frictional engagement between the mating portions of the threads. One such thread locking device is "ND PELL-IT" (Registered Trade Mark). A similar product, "NYLOK" (Registered Trade Mark), is also commercially available. The result of removal torque tests with a ⅛" diameter plastics insert 66 as shown in FIG. 5B is shown as test number 3 of Table 1. Standard No. 8 cup point setscrews and variants thereof were also tested. As shown in FIG. 5C, the standard setscrew configuration 68 can be modified to include a tip 70 made of a relatively soft material. A setscrew 68 with a tip 70 is shown mounted in a threaded ring 60 in FIG. 5D. Standard setscrews and setscrews with tips of brass and the same tough plastics as above were tested. The results are shown respectively as tests 4, 5 and 6 of Table 1. Each setscrew was tightened into the threads 40 of the cutter 18 after the cutter 18 and the threaded ring 60 were assembled onto the bearing spindle 16. In this prior art arrangement, the holding torque of these setscrews is determined primarily by the axial force they exert upon the cutter threads, called the axial holding power. Deformation of the relatively soft tips of the tipped setscrews helps increase the friction coefficient slightly, with a resulting increase in holding torque. There is no significant deformation of the cutter threads themselves.

Based upon Table 23 on pages 8–31 of Marks Standard Handbook for Mechanical Engineers, seventh edition, a No. 8 cup point setscrew has an axial holding power of 385 lb. Based upon Note 1 listed below this table and the dimensions of the rings tested, the setscrew has an expected holding torque of about 37 ft-lbs. Test No. 4 showed breakout torque with this design to be less than 10 ft-lbs, dropping to less than 5 ft-lbs torque within a 90 degree revolution. The plastics tipped setscrew, Test No. 5, had about the same breakout torque, and the brass tipped setscrew, Test No. 6, had only slightly higher breakout torque. The inventors believe that the various setscrews and the plastics thread inserts were ineffective partly due to the superior lubricity of the rock bit grease present and the high hardness (40 Rc) of the threads in the cutter.

TABLE 1

Test Results of Various Thread Locking Means

| Locking method | Breakout torque | Torque @ 1 Rev |
|---|---|---|
| Prior Art: | | |
| 1. Prior art thread locking compound | 0–180 ft-lb (inconsistent) | 30 ft-lb |
| 2. Assembly torque of 200 ft-lbs | 5 ft-lb | <1 ft-lb |
| 3. Prior art plastics thread insert | 5 ft-lb | <5 ft-lb |
| 4. Prior art setscrew | 5-10 ft-lb | <5 ft-lb |
| 5. Prior art setscrew with plastics tip | 5-10 ft-lb | <5 ft-lb |
| 6. Prior art setscrew with brass tip | 15 ft-lb | <5 ft-lb |
| Present Invention: | | |
| 7. Thread "peening" in accordance with the present invention | 100–120 ft-lb | >200 ft-lb |
| 8. "Pinning" device in accordance with the present invention | 140 ft-lb | 40 ft-lb |

With the exception of thread locking compound, the conventional means of thread locking shown above are not suitable for retention of the threaded ring within a drill bit, exhibiting a maximum breakout torque of only 15 ft-lbs. Also, field results often shown degradation of the thread locking compound's breakout torque, frequently less than 5 ft lbs at disassembly, with many assemblies showing evidence of loosened threaded rings. By comparison, however, the mechanisms of the present invention consistently exhibit breakout torques in excess of 100 ft-lbs. None of the approximately 1000 drill bits tested to date with threaded rings secured by the "peening" method have had failures due to loosened threaded rings. Therefore, it can be seen that the mechanisms of the present invention provide threaded ring retention performance superior to all previous retention mechanisms.

We claim:

1. A method of manufacturing a rolling cutter drill bit of the kind comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, the method comprising the steps of providing in one of said retention ring and the component which it screw-threadedly engages an aperture which passes through a portion of one of the screw-threads to expose a portion of the other screw-thread, forming the drill bit with a passage which extends from the exterior of the bit to said aperture in said one screw-thread so as to provide access to said exposed portion of the other screw-thread, and physically altering said exposed portion of the other screw-thread in a manner to prevent subsequent relative rotation between the screw-threads, thereby locking the retention ring to the component which it screw-threadedly engages.

2. A method according to claim 1, wherein said exposed portion of the other screw-thread is physically altered by being mechanically deformed by an implement inserted along said passage and through said aperture.

3. A method according to claim 2, wherein said mechanically deformed other screw-thread is provided with greater yield strength than said one screw-thread containing said aperture.

4. A method according to claim 2, wherein said exposed portion of the other screw-thread is plastically deformed by impact thereon of said implement.

5. A method according to claim 1, wherein the retention ring is in screw-threaded engagement with the cutter, the retention ring having an external screw-thread which engages an internal screw-thread on an interior surface of a cavity formed in the cutter.

6. A method according to claim 5, wherein said aperture is formed in the retaining ring and exposes a portion of the internal screw-thread on the cutter, said passage being formed in the bearing spindle and extending from the exterior of the bit to said aperture in the retaining ring to provide access, through said passage and aperture, to said exposed portion of the screw-thread on the cutter.

7. A rolling cutter drill bit comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, there being provided in one of said retention ring and the component which it screw-threadedly engages an aperture which passes through a portion of one of the screw-threads to expose a portion of the other screw-thread, said exposed portion of the other screw-thread being physically altered in a manner to prevent relative rotation between the screw-threads, thereby locking the retention ring to the component which it screw-threadedly engages.

8. A method of manufacturing a rolling cutter drill bit of the kind comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, the method comprising the steps of providing in one of said retention ring and the component which it screw-threadedly engages an aperture which passes through a portion of one of the screw-threads to expose a portion of the other screw-thread, forming the drill bit with a passage which extends from the exterior of the bit to said aperture in said one screw-thread so as to provide access to said exposed portion of the other screw-thread, providing a recess in said exposed portion of the other screw-thread, and securing in said aperture a pinning element having a portion which engages within said recess in a manner to prevent subsequent relative rotation between the screw-threads, thereby locking the retention ring to the component which it screw-threadedly engages.

9. A method according to claim 8, wherein said recess is formed in the exposed portion of said other screw-thread by physically deforming said exposed portion of the screw thread after assembly of the cutter, retention ring and spindle.

10. A method according to claim 9, wherein said recess is formed by mechanical deformation of the exposed portion of said other screw-thread by an implement inserted along said passage and through said aperture.

11. A method according to claim 10, wherein said recess is formed by impact on the exposed portion of said other screw-thread by said implement.

12. A method according to claim 8, wherein said recess is pre-formed in the exposed portion of said other screw-thread prior to assembly of the cutter, retaining ring and spindle, and is brought into register with the aperture in said one screw-thread, to receive said portion of the pinning element, during said assembly.

13. A method according to claim 8, wherein the retention ring is in screw-threaded engagement with the cutter, the retention ring having an external screw-thread which engages an internal screw-thread on an interior surface of a cavity formed in the cutter.

14. A method according to claim 13, wherein said aperture is formed in the retaining ring and exposes a portion of the internal screw-thread on the cutter, said passage being formed in the bearing spindle and extending from the exterior of the bit to said aperture in the retaining ring to provide access, through said passage and aperture, to said exposed portion of the screw-thread on the cutter.

15. A rolling cutter drill bit comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, there being provided in one of said retention ring and the component which it screw-threadedly engages an aperture which passes through a portion of one of the screw-threads to expose a portion of the other screw-thread, a recess in said exposed portion of the other screw-thread, and secured in said aperture a pinning element having a portion which engages within said recess in a manner to prevent relative rotation between the screw-threads, thereby locking the retention ring to the component which it screw-threadedly engages.

16. A method of manufacturing a rolling cutter drill bit of the kind comprising a bit body, at least one bearing spindle on the bit body, a rolling cutter rotatably mounted on the bearing spindle, and a retention assembly mounted between said cutter and spindle, the retention assembly comprising a threaded retention ring coaxial with the spindle and in screw-threaded engagement with one of said cutter and spindle, the method comprising the steps of providing in one of said retention ring and the component which it screw-threadedly engages an aperture which passes through a portion of one of the components to expose a surface portion of the other component, forming the drill bit with a passage which extends from the exterior of the bit to said aperture so as to provide access to said exposed surface portion, providing a recess in said exposed surface portion, and securing in said aperture a pinning element having a portion which engages within said recess in a manner to prevent subsequent relative rotation between the retention ring and the component which it screw-threadedly engages.

* * * * *